United States Patent [19]

Weikert

[11] Patent Number: 4,893,453

[45] Date of Patent: Jan. 16, 1990

[54] PACKAGING SYSTEM AND METHOD

[76] Inventor: Roy J. Weikert, c/o Asepak Corporation, 1915 E. Simpson Ave., Suite #1, Fresno, Calif. 93703-1043

[21] Appl. No.: 301,197

[22] Filed: Jan. 24, 1989

[51] Int. Cl.[4] ..... B65B 3/04; B65B 7/06; B65B 43/52

[52] U.S. Cl. ..... 53/469; 53/266 R; 53/570; 141/90; 141/280

[58] Field of Search ..... 53/239, 266 R, 459, 53/468, 469, 474, 567, 570; 141/90, 114, 248, 280

[56] References Cited

U.S. PATENT DOCUMENTS

| | | | |
|---|---|---|---|
| 3,583,127 | 6/1971 | Marchand | 53/570 X |
| 3,813,845 | 6/1974 | Weikert | 53/266 R |
| 4,021,283 | 5/1977 | Weikert | 53/426 |
| 4,074,507 | 2/1978 | Ruf et al. | 141/114 X |
| 4,445,548 | 5/1984 | Neumann | 141/248 X |
| 4,671,044 | 6/1987 | An | 53/469 X |
| 4,749,008 | 6/1988 | Whitney et al. | 141/248 X |

*Primary Examiner*—Robert L. Spruill
*Assistant Examiner*—Linda B. Johnson
*Attorney, Agent, or Firm*—Biebel, French & Nauman

[57] ABSTRACT

Successive bags of material which are interconnected in a continuous web along the tops thereof by an integral tubular portion of the web, and which are individually open to the tubular portion but sealed from each other by seams extending along the adjacent sides thereof, are filled by an elongated filling pipe along which a tubular portion of the web is drawn. The underside of the pipe is provided with two spaced ports through which material is delivered into the successive bags, and in order to prevent material from accumulating above the adjacent seam portions of contiguous bags, these ports are alternately opened and closed in such timed relation with the feeding movement of the bags that each port is open when only one bag is passing thereunder and is closed when one of the seams is thereunder.

9 Claims, 2 Drawing Sheets

22
25
40
41
42
44
45
46
47
48
50
51
56
60
61
65
3
4

PACKAGING SYSTEM AND METHOD

BACKGROUND OF THE INVENTION

This invention relates to machines and methods for filling and sealing a series of pouches or bags of plastic or other material such as plastic-foil laminates on a continuous basis, and it has particular relation to machines and methods of the type shown in co-owned Weikert U.S. Pat. Nos. 3,813,845 and 4,021,283.

In the apparatus disclosed in those patents, a tube of material is first divided into a series of contiguous bags or pouches sealed from each other along their adjacent sides but interconnecting through a continuous tubular portion which initially forms a common top for all of the bags. The tubular portion of this web is drawn along an elongated filling pipe having a discharge port at one end from which the material with which the bags are to be filled is poured into each successive bag, with this processing line being tilted upwardly so that excess material in one bag will spill over into the adjacent following bag. After each bag is filled, it is sealed across the top and severed from the tubular portion as a separate, filled and sealed package.

The apparatus and methods disclosed in the above patents have been widely used and outstandingly successful in connection with a wide range of materials. In general, however, they have been most successful for packaging essentially liquid materials, e.g. milk, and problems have sometimes developed when the material to be packaged was a suspension of relatively large particulate material, e.g. filling for an apple pie containing chunks of apple. With such materials, pieces of the solid constituents of the mix can accumulate above the seam between contiguous bags in the web, particularly if the mix overflows a bag into the adjacent following bag, and thereafter interfere with proper sealing of the filled bags. The present invention is directed particularly to eliminating the possibility that such accumulation of solids can occur.

SUMMARY OF THE INVENTION

The apparatus and method developed in accordance with the invention follow closely in some respects the disclosures of the above-noted Weikert patents, in that a continuous web of material is first sub-divided into a series of bags or pouches sealed from each other along their sides but all communicating at their tops with a tubular portion of the web. This tubular portion is drawn along a filling pipe to which the material to be packaged is supplied, with the successive bags depending from the continuous tubular portion of the web.

In contrast with the apparatus shown in the above patents, wherein the filling pipe has a single discharge outlet from which the successive hags are filled as the web is fed along the pipe, the filling pipe in the apparatus of the invention is provided with a pair of discharge ports spaced lengthwise of the pipe in such manner that a single bag cannot receive material from both ports simultaneously. In addition, the discharge end of the filling pipe is provided with a valve proportioned to close either one of the two discharge ports, but not both ports at the same time, and this valve is mounted to shuttle lengthwise of the filling tube between two limit positions such that it alternately closes one port and opens the other.

In operation, the web of successive bags is drawn along the filling pipe at a constant speed, and the material to be packaged is supplied to the filling pipe at a constant flow rate. As the web is drawn along the pipe, the valve controlling the two discharge ports shuttles back and forth to open and close the discharge ports in such timed relation with the movement of the web that each port is open only when one of the bags is passing directly thereunder, but when the seam or junction portion between adjacent bags is under either port, that port will be closed.

Other objects and advantages of the invention, and specific means by which they are accomplished and provided, will be apparent from or pointed out in the course of the description of the preferred embodiments which follows.

DESCRIPTION OF THE PREFERRED EMBODIMENTS

Figure 1:
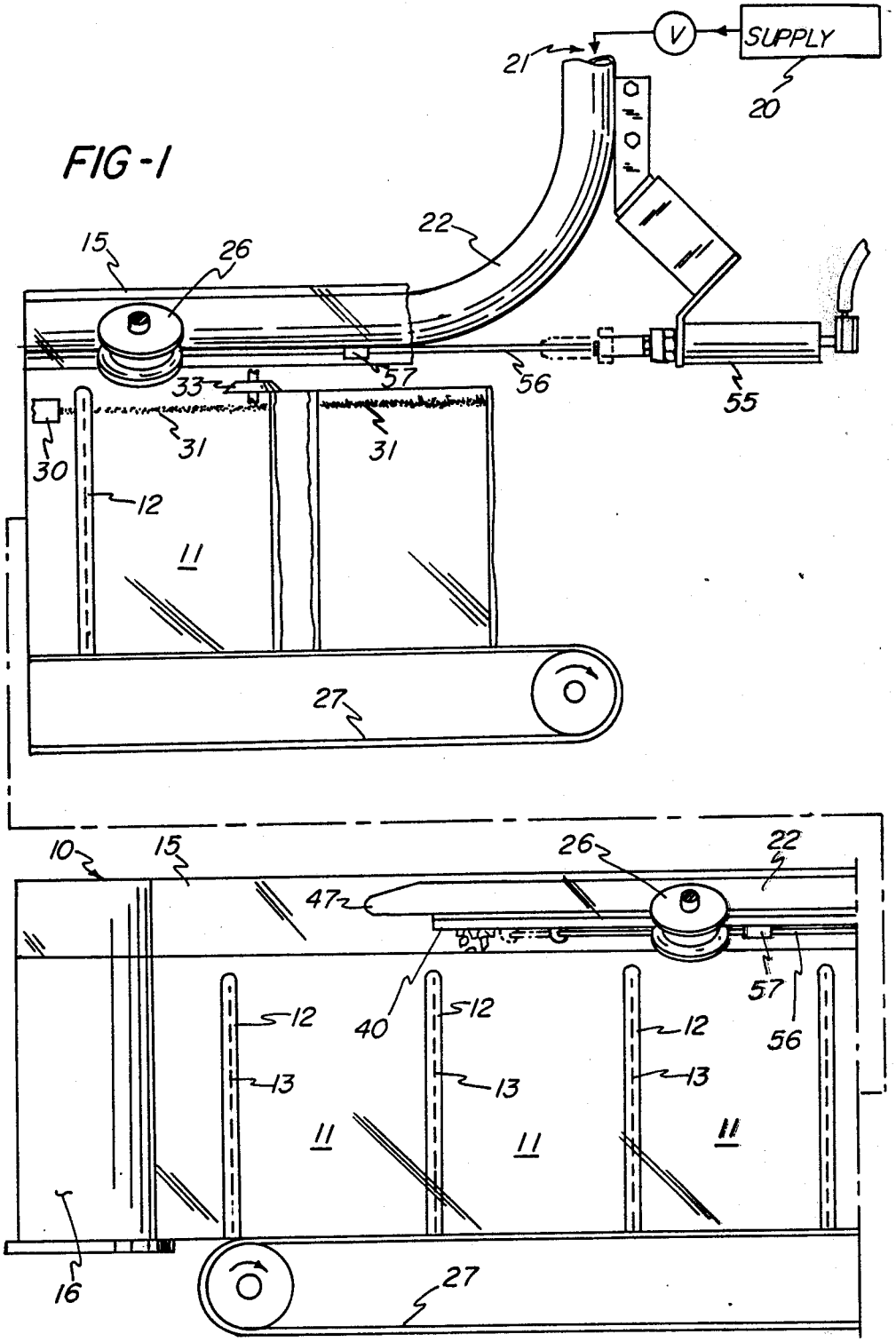
FIG. 1 is a somewhat diagrammatic side elevation in two sections of key parts of a filling and sealing system in accordance with the present invention.

In FIG. 1, a web 10 is initially a continuous, closed tube of material, typically a plastic-foil laminate, which is separated into successive pouches or bags 11 that are interconnected along their adjacent side edges by a heat-sealed seam 12 provided with a line of serrations 13 along which the filled pouches are subsequently separated from each other. The seams 12 do not extend to the top of the web 10 so that the interior of all of the empty bags 11 are interconnected along the tops thereof by a continuous tubular portion 15 which runs along the top of the web.

The tube 10 may conveniently be formed by extrusion of a thermoplastic, followed by seaming and perforating, or in any other convenient way as disclosed in the above Weikert patents. Also, the web 10 may be formed as part of an in-line process with the filling and sealing process, or it may be formed separately and provided to the system as a roll 16, as shown in FIG. 1, or in fan-folded form.

The fluent material with which successive bags 11 are to be filled is initially provided under pressure from a supply source 20 to the inlet end 21 of an elongated filling pipe 22. The pipe 22 is supported at its inlet end by any convenient means so that it extends horizontally in cantilever fashion to its discharge end 25. The filling pipe 22 is proportioned to be freely receivable in the tubular portion 15 of the web 10, which is drawn along the pipe 22 by means such as pairs of feed rollers 26 driven by any convenient means. In addition, the successive filled bags 11 are shown as supported from below by a continuous driven conveyor belt 27.

As described in more detail below, the successive bags 11 are filled as they pass under the discharge end of the filling pipe 22, and they are then heat sealed along the tops thereof as they pass heat sealing apparatus indicated at 30 which provides a horizontal seal line 31 intersecting the ends of the side seams 12. Each filled bag then passes between a pair of cutter wheels 33 which sever the tubular portion 15 lengthwise and thereby separate the filled bags from the web 10. It will be understood that the disclosure herein in connection with FIG. 1 is essentially schematic, and may be supplemented by reference to the more detailed disclosure in the above U.S. Pat. No. 3,813,845 which is incorporated herein by reference.

The primary purpose of the present invention is to insure that each successive bag 11 receives material from the filling pipe 22 only when it is directly under a port in pipe 22, so that the fluent material is delivered directly to the interior of the bag rather than having any of it spill from one bag to the next or otherwise come in contact with the upper ends of the seams 12. This objective is accomplished by providing the feeding pipe with a pair of discharge ports spaced from each other lengthwise of the underside of the pipe, and by alternately opening and closing these ports in timed relation with the movement of the web 10 along pipe 22 in such manner that each of these ports is open only when one of the bags 11 is directly thereunder and is closed when a seam 12 between adjacent bags is thereunder.

More specifically, an elongated opening is cut in the underside of the pipe 22 by removing therefrom a section extending approximately 120° around the underside of the pipe, and this opening is filled by a correspondingly sized plate 40, which may be of a suitable molded plastic such as Delrin. This plate 40 has a pair of longitudinally spaced ports 41 and 42 therethrough, and it has a groove 44 along each side thereof into which the adjacent edge portions of the pipe 22 fit. The plate 40 also includes an extension 45 its outer end which includes an upward detent barb 46 that is anchored in a complementary receptacle in the plate 47 which closes the end of pipe 22. The end of the pipe 22 beyond the plate 40 preferably includes a prow-shaped portion 48 that acts as a pilot for the tubular portion 15 of the web 10 as it is drawn along pipe 22.

Figures 2, 3, 4, 5:
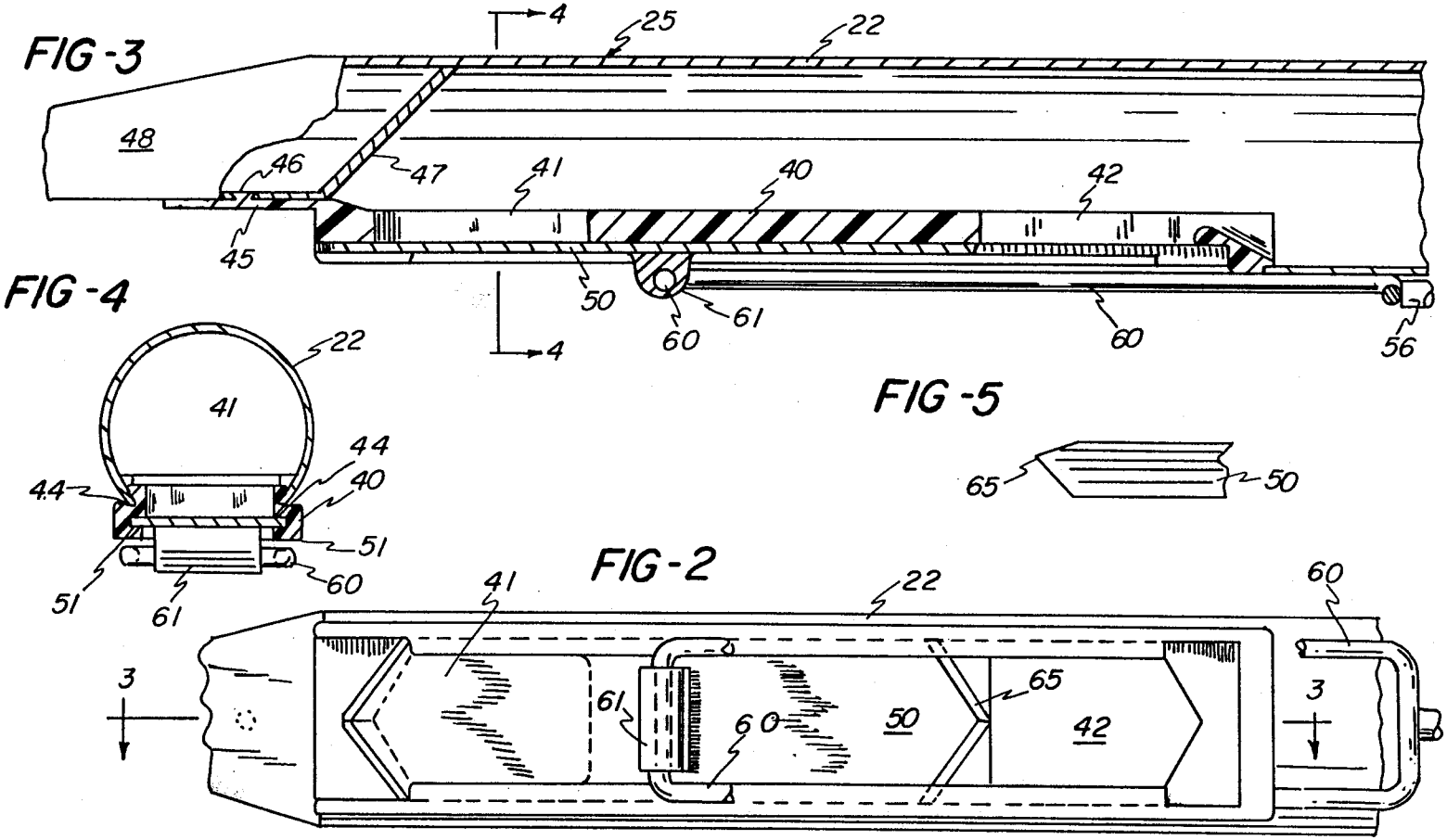
FIG. 2 is an elevational view of the underside of the discharge end of the filling pipe shown in FIG. 1.
FIG. 3 is a section on the line 3—3 in FIG. 2.
FIG. 4 is a section on the line 4—4 in FIG. 3.
FIG. 5 is a fragmentary side view, on an enlarged scale, of the valve member also shown in FIGS. 2–4.

As shown in FIG. 2, the ports 41 and 42 are rectangular in outline but with their opposite ends pointed, to an included angle shown as 120°. They are alternately opened and closed by a complementarily shaped valve member 50 of metal plate stock, preferably stainless steel, mounted to slide lengthwise of plate 40 in a track formed by opposed grooves 51 in the depending sides of plate 40.

The valve 50 is shuttled back and forth between limit positions in which it alternately opens one of the ports 41 and 42 and closes the other of those ports. Drive means for effecting this action includes a double-acting air cylinder 55 (FIG. 1) fixedly supported near the inlet end 21 of filling pipe 22. A rod 56 is supported in guides 57 welded to the underside of pipe 22 and leads from the piston of air cylinder 55 to a rectangular loop 60 of wire having its downstream ends inserted in the opposite ends of a through bore in a bracket 61 welded across the middle of the underside of valve 50. As shown in FIG. 3, the wire loop 60 is proportioned to lie outside the periphery of port 42 so that it can never interfere with the discharge of material through port 42.

The ends of the valve 50 are pointed similarly to the ends of the ports 41 and 42, but at a somewhat sharper angle, shown as an included angle of 110°. They are also to a knife edge 65 (FIG. 5), preferably with the lower side of the knife edge being ground at 45° to the length of the valve 50, while the upper side of the knife edge is ground to an angle of 15°. If, therefore, any solid material, such as a piece of apple, is passing through one of ports 41–42 when it is closed by valve 50, the knife edge 65 will shear through any such solid material.

The size and spacing of the ports 41–42 are dictated in large measure by the size of the bags 11 to be filled therethrough. Other variables which require coordination in the practice of the invention include the rate of travel of the tube 10 along the pipe 22 and the flow rate of the material with which the successive bags are filled. More specifically, successful practice of the invention requires that there be an interval during the travel of each successive bag 11 along the discharge end of pipe 22 when the open upper end of the bag extends from a position beyond the pointed end of port 42 to a position in advance of the pointed end of port 41.

This relationship is necessary because as each bag 11 travels along pipe 22, it will first receive fluent material from the port 41 while the port 42 is closed by valve 50. This filling action will continue as the bag travels to a position wherein its leading edge has passed beyond the port 42, but its trailing edge has still not reached the pointed end of port 41, and it is at this juncture that the valve 50 is shifted to open port 42 and then close port 41 while the bag is still in position to receive material from either port.

In view of these essential operating relationships, it will now be seen that the plate 40 should be configured with specific reference to a particular size of bags 11 with which it is to be used. As a specific example, for bags 11 which are six inches in width between the inner edges of their side seams 12, each of the ports 41 and 42 may be of a total length of 1.50 inches, and their adjacent spaced 2.75 inches apart, so that the total distance between their pointed ends will be 5.75 inches. In this example, therefore, the valve 50 may have an overall length of 4.50 inches, and the stroke of cylinder 55 should be sufficiently greater than 1.50 inch to assure that in each of the limit positions of valve 50, it will fully close one of ports 41 and 42 while leaving the other of those ports fully open. A stroke of 1.75 inches has been found satisfactory.

In this example, each bag 11 will begin to pass under port 41 while the immediately preceding bag is still being filled by way of the port 42. The filling of that preceding bag will be completed before its trailing edge seam 12 reaches port 42, and at that instant, the valve 50 will be shifted to close port 42 and open port 41 to begin filling the following bag. Port 41 will remain open until the leading edge of this second bag has passed beyond the pointed end of port 42, whereupon the valve 50 will again switch to close port 41 while filling of the bag proceeds by way of port 42.

This sequence of related operations assures that each port will be open only when a bag is beneath it in position to be filled therefrom, and will be closed whenever the seams between adjacent bags are passing thereunder. It will also be seen that the pointed ends of ports 41 and 42 contribute to the desired purpose of the invention, because during the interval while the filling of each bag is transferred from port 41 to port 42, the open upper end of the bag will have in plan a roughly boat-like outline having broadly pointed ends which will lie under the pointed ends of the two ports, and they will control the cross flow shape of the stream of material so that it is directed into the trailing end of the bag and then into its leading end.

Control of the system to assure that each successive bag will be filled with the proper amount of material may be provided by any of the metering expedients disclosed in the above U.S. Pat. No. 3,813,845. Similarly, the frequency of the shuttling movements of the valve 50 may be controlled by any of a variety of expedients, such as means sensing the weight of each filled passage, an electric eye which registers arrival of each successive bag at the position wherein it can receive material from either port, or means responsive to the feeding movement of the web 10.

While the method herein described, and the form of apparatus for carrying this method into effect, constitute a preferred embodiment of this invention, it is to be understood that the invention is not limited to this precise method and form of apparatus, and that changes may be made in either without departing from the scope of the invention which is defined in the appended claims.

What is claimed is:

1. Apparatus for packaging a fluent material in successive pouches of material which are interconnected in a continuous web along the tops thereof by an integral tubular portion of said web and which are individually open to said tubular portion but are sealed from each other by seams extending along the adjacent sides thereof, comprising:

(a) an elongated filling pipe proportioned for insertion in said tubular portion of said web and having an inlet end and a discharge end, (b) means for supplying a flow of fluent material to be packaged to said inlet end of said pipe, (c) means at said discharge end of said pipe forming a pair of outlet ports spaced from each other lengthwise of the underside of said pipe, (d) means for drawing said tubular portion of said web along said pipe with said pouches depending therefrom to receive said material from said outlet ports, and (e) means for alternately opening and closing each of said outlet ports in timed relation with said drawing means whereby each of said ports is open only when one of said pouches is passing thereunder and is closed when one of said seams is thereunder.

2. Apparatus for packaging a fluent material in successive pouches of material which are interconnected in a continuous web along the tops thereof by an integral tubular portion of said web and which are individually open to said tubular portion but are sealed from each other by seams extending along the adjacent sides thereof, comprising:

(a) an elongated filling pipe proportioned for insertion in said tubular portion of said web and having an inlet end and a discharge end, (b) means for supplying a flow of fluent material to be packaged to said inlet end of said pipe, (c) an extended plate forming the bottom of said discharge end of said pipe, (d) said plate having therein a pair of outlet ports spaced from each other lengthwise of said pipe, (e) means for drawing said tubular portion of said web along said pipe with said pouches depending therefrom to receive said material from said outlet ports, and (f) means including valve means carried by said plate for alternately opening and closing each of said outlet ports in timed relation with said drawing means whereby each of said ports is open only when one of said pouches is passing thereunder and is closed when one of said seams is thereunder.

3. Apparatus as defined in claim 2 wherein said valve of said opening and closing means is mounted for movement lengthwise of said plate between limit positions closing one or the other of said outlet ports and opening the other said port, and drive means for effecting such back and forth movement of said valve.

4. Apparatus as defined in claim 3 wherein said valve is a plate member having a knife edge at each end thereof for cutting solid material in the path thereof between said limit positions.

5. Apparatus as defined in claim 3 wherein said plate member has a pair of knife edges at each end thereof which extend at opposed angles to its said path for shearing solid material in said path.

6. Apparatus as defined in claim 1 wherein each of said pouches is of the same predetermined width between the inner edges of the seams thereof, and wherein the distance between the ends of said outlet ports remote from each other is less than said pouch width whereby during the travel of each of said pouches below said pipe, each said pouch will for an interval be in position to receive said material from both of said outlet ports.

7. Apparatus as defined in claim 6 wherein the ends of said ports remote from each other are pointed to control the cross-flow shape of the flow of material therethrough.

8. Apparatus as defined in claim 3 wherein said drive means includes an elongated loop attached at one end to said valve, and means attached to the other end of said loop for effecting linear reciprocating movement of said loop, and further characterized in that said loop encloses an area wider than said ports and of such length as to lie outside of the vertical projection of the one of said ports nearer to said reciprocating means when said valve is in its said limit position closing the other of said ports.

9. The method of packaging fluent material in successive pouches of material which comprises the steps of:

(a) supplying a continuous web of pouches consisting of a closed tube having upper and lower edges and spaced seam lines extending upwardly to a level spaced from said tube upper edge to form a series of pouches which are interconnected at the tops thereof by an integral tubular portion of said web and which are individually open to said tubular portion but are sealed from each other by said seam lines extending along the adjacent sides thereof, (b) inserting in said tubular portion an elongated filling pipe having a discharge end provided with two outlet ports in the underside thereof, (c) drawing said web along said pipe with said pipe received in said tubular portion thereof, (d) continuously supplying material to be packaged to said pipe for discharge therefrom through said outlet ports, (e) alternately opening and closing said outlet ports in timed relation with said drawing movement of said web whereby each of said ports is open only when one of said pouches is passing thereunder and is closed when one of said seam lines is thereunder, and (f) containing said material in each of the resulting filled said pouches by sealing said tube along a line intersecting said seam lines adjacent the upper ends thereof.

* * * * *